United States Patent [19]

Miller et al.

[11] Patent Number: 4,458,902

[45] Date of Patent: Jul. 10, 1984

[54] QUOIT-LIKE GAME PIECE

[76] Inventors: James F. Miller, 2269 Quebec Rd.; Robert C. Cost, 2261 Quebec Rd., both of Hamilton County, Cincinnati, Ohio 45214

[21] Appl. No.: 459,313

[22] Filed: May 31, 1983

[51] Int. Cl.[3] ..... A63B 65/10

[52] U.S. Cl. ..... 273/427; D21/4

[58] Field of Search ..... 273/428, 427, 343, 336–339; D21/4, 50

[56] References Cited

U.S. PATENT DOCUMENTS

| | | | |
|---|---|---|---|
| D. 219,822 | 2/1971 | Rockaitis | 273/427 X |
| D. 220,272 | 3/1971 | Triplett | D21/50 |
| 2,059,378 | 11/1936 | Madison | 273/427 |
| 2,584,260 | 2/1952 | Custer | 273/427 |
| 3,595,578 | 7/1971 | Burcenski | 273/343 |
| 3,762,710 | 10/1973 | De Coninck | 273/427 |
| 3,917,269 | 11/1975 | Paquette | 273/343 |

*Primary Examiner*—Paul E. Shapiro

*Attorney, Agent, or Firm*—Walter S. Murray

[57] ABSTRACT

A flat, quoit-like game piece to be tossed at a target pin and having a plurality of target receiving recesses, each recess formed with a pair of spaced and confronting pin engaging hooks and an angular deflector point formed on the quoit between each pair of hooks to provide many scoring possibilities depending on the skill of a player.

2 Claims, 4 Drawing Figures

FIG. 1
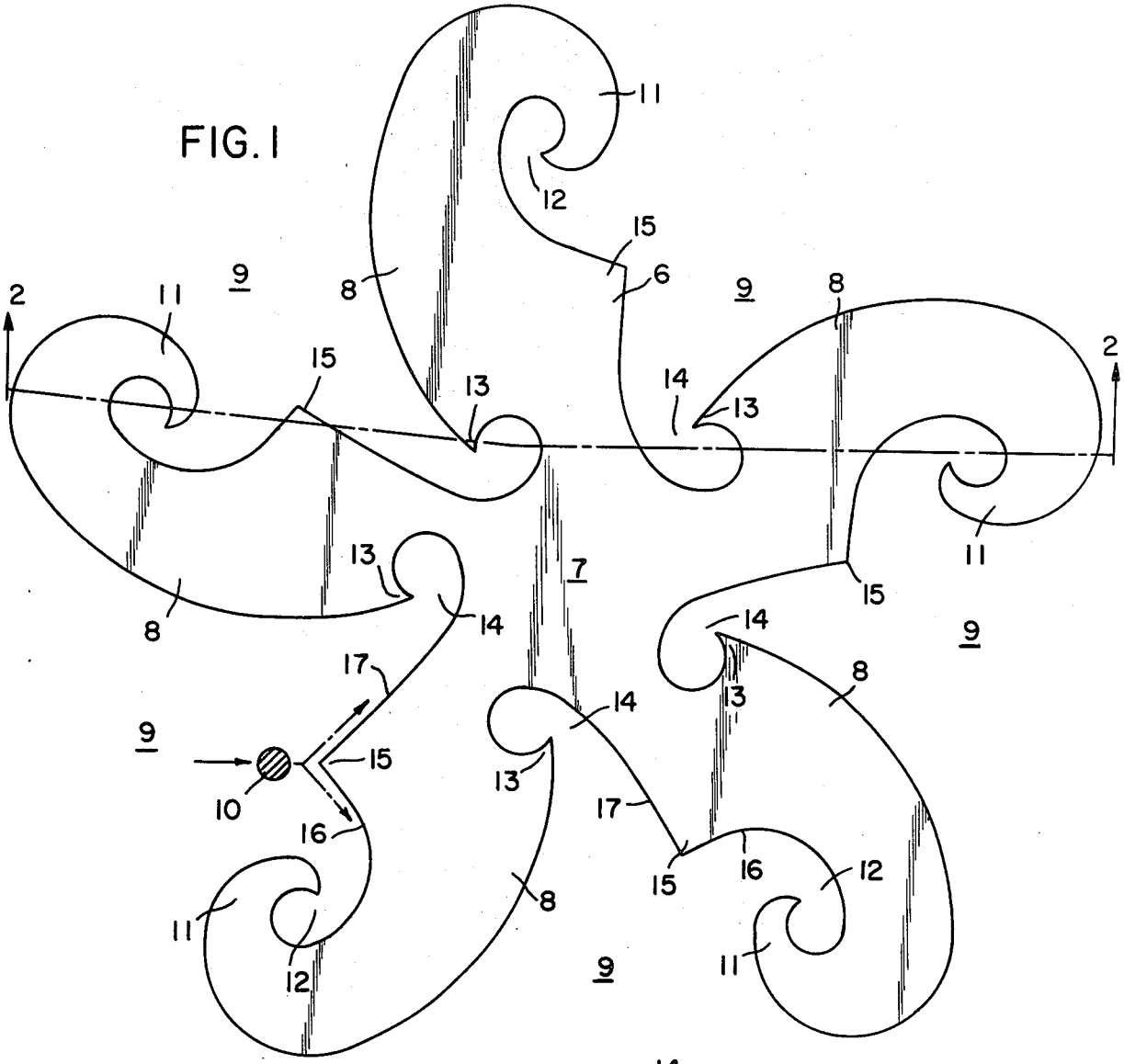
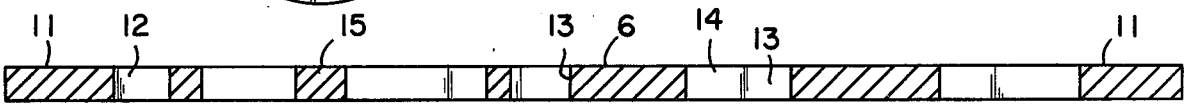
FIG. 2
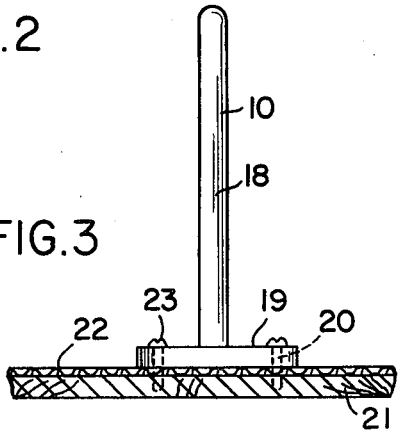
FIG. 3
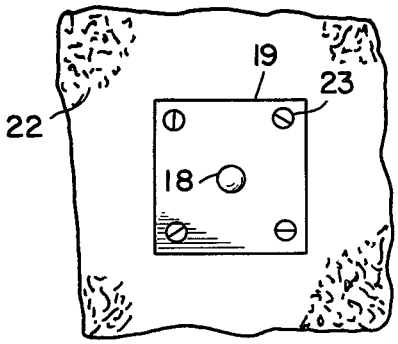
FIG. 4

QUOIT-LIKE GAME PIECE

BACKGROUND AND SUMMARY OF THE INVENTION

This invention relates to a quoit-like game piece adapted to be thrown at a target pin in a manner to obtain many scoring possibilities presented by a plurality of hooks formed in the game piece. Conventional quoits take many forms and permit a number of scoring possibilities depending on the skill of the player to encompass the pin with a proper hook presented in the body of the quoit-like game piece.

The quoit of this invention provides additional scoring possibilities depending upon the unique contour of our quoit and the rotary or non-rotary motion given the quoit by a player upon release of the quoit toward a target pin.

The quoit of this invention may be made from any material but is preferably made of plastic or rubber in order that a quoit game may be played indoors as well as out-of-doors.

It is an object of the present invention to provide a novel quoit-like game piece that has a plurality of target pin receiving recesses formed in the quoit body, each recess including two pin engaging hooks and an angular deflector point on the body adapted to urge a target pin entered in the recess into either hook thus providing multiples of scoring possibilities. Additional features of the invention can become apparent from the following description with reference to the accompanying drawings which show the preferred embodiment of our quoit.

BRIEF DESCRIPTION OF THE DRAWINGS

FIG. 1 is a plan view of the quoit-like game piece of this invention.

FIG. 2 is a section taken on line 2—2 of FIG. 1.

FIG. 3 is an elevational view, partly in section, showing the preferred indoor target pin used with the quoit-like game piece of this invention.

FIG. 4 is a top plan view of the target pin as shown in FIG. 3.

DETAILED DESCRIPTION OF THE INVENTION

With reference to FIGS. 1 and 2 of the drawings the composite quoit-like game piece of this invention comprises a flat body 6 preferably made of a plastic or rubber material and having an imperforate hub 7 and a plurality of identically shaped arms 8 radiating from the hub. The arms 8 are equi-distantly spaced apart to define in the body, between adajacent arms, similarly contoured outwardly facing recesses 9. As best shown in FIG. 1 of the drawings a target pin 10 may enter one of the recesses 9 when the quoit is acurately thrown at the pin.

A pin engaging first hook 11 is formed on the outer end of each arm 8. Each hook 11 is provided with a bight 12 having a width slightly larger than the diameter of the target pin 10; all the bights 12 on the arms 8 facing in one circumferential direction.

A pin engaging second hook 13 is formed in the quoit-like body at the base of each arm 8, each of said second hooks having a bight portion 14 that is slightly wider than the diameter of the target pin 10. These bight portions 14 face in the same circumferential direction opposed to the facing directions of the bights 12 of the first hooks 11. Target deflector, angular points 15 are formed on the flat body 6 of the quoit between adjacent first hooks 11 and the second hooks 13, each point 15 projecting outwardly into a recess 9. As depicted in FIG. 1 the quoit body 6 is provided with curved edges 16 and 17 disposed on opposite sides of each point 15, these curved edges serving as target pin leads into the bight portions 12 and 14 respectively, of the first hook 11 and the second hook 13, respectively.

Depending on the throwing ability of a player using the quoit-like game piece of this invention and on other aerodynamic factors a well directed piece thrown at a target pin will be entered into one of the recesses 9 and, as shown in FIG. 1, a pin approximately centered in a recess 9 will be deflected by a point 15 into either a first hook 11 or a second hook 13 by the guidance of the curved edges formed on the quoit body on opposite sides of the deflector points.

The kind of material and the thickness of said quoit-like game piece may be empirically determined to secure the proper body weight that will carry the piece on a straight flight path to a target pin without drift to either side of the path due to air currents, or the like. A player may grasp the game piece by any of its arms 8 and throw in horse shoe-like fashion for easy delivery toward a target pin. It will be understood from the foregoing description that our quoit-like body will provide a multitude of scoring possibilities in that the outer hooks will have lower numerical scores while the inner hooks could provide higher scoring possibilities.

With reference to FIGS. 3 and 4 of the drawings we show a prefered construction for the target pin 10 to be used in playing indoor games with our quoit-like game piece. This pin is made of one-piece plastic material and has a stake part 18 and a base 19, the base being formed with holes 20. The target pin construction is mounted on a plywood platform 21 covered with an impact deadening material 22 by means of wood screws 23 passed through the holes 20 and threaded into the platform 21.

We claim:

1. A composite, flat quoit-like body having an imperforate hub, a plurality of identically contoured arms connected to, and radiating from the hub, the arms being equi-distantly spaced in one circumferential direction to define on the body, and between adjacent arms, similar outwardly facing target receiving recesses in the body, a pin receiving first hook formed on the outer end of each arm, the first hooks having bights facing in the same circumferential direction, a second pin receiving hook formed in the body at the base of each arm and each having a bight portion facing in the same circumferential direction opposed the facing directions of the bights of the first hooks, and a pin engaging deflector point formed on the body between the first and second hooks and projecting outwardly into a recess, said points being adapted to deflect a pin entering a recess into either the first or the second hook.

2. The composite, flat quoit-like body according to claim 1 wherein the body is provided with curved edges disposed on opposite sides of each point, and each curved edge leading into a bight of the first and second hook.

* * * * *